United States Patent [19]

Dahlström

[11] 4,248,024

[45] Feb. 3, 1981

[54] CENTERING FOR CASTING CONCRETE ROOFS

[76] Inventor: Claes-Inge S. Dahlström, Patron Lars väg 18, S-12140 Huddinge, Sweden

[21] Appl. No.: 15,774

[22] Filed: Feb. 28, 1979

[30] Foreign Application Priority Data

Mar. 2, 1978 [SE] Sweden ..... 7802401

[51] Int. Cl.[3] ..... E04G 25/00

[52] U.S. Cl. ..... 52/632; 249/27; 249/28

[58] Field of Search ..... 249/18, 27, 28; 52/646, 52/662, 664, 632

[56] References Cited

U.S. PATENT DOCUMENTS

| | | | |
|---|---|---|---|
| 2,846,931 | 8/1958 | Priest | 52/669 |
| 3,325,957 | 6/1967 | Demeales | 52/632 |
| 3,744,945 | 7/1973 | Metrailer | 249/18 |
| 4,078,759 | 3/1978 | Lanier | 249/18 |

FOREIGN PATENT DOCUMENTS

| | | | |
|---|---|---|---|
| 810081 | 5/1951 | Fed. Rep. of Germany | 52/632 |
| 1803626 | 6/1970 | Fed. Rep. of Germany | 249/28 |
| 1001586 | 2/1952 | France | 52/632 |
| 1079090 | 11/1954 | France | 52/646 |

*Primary Examiner*—Price C. Faw, Jr.
*Assistant Examiner*—Henry E. Raduazo
*Attorney, Agent, or Firm*—Burton, Parker & Schramm

[57] ABSTRACT

A centering for casting concrete roofs comprising a rectangular steel construction including at least two longitudinal girders (1, 2) and a plurality of spaced cross beams (3) welded thereto constituting a support of a flat form board for casting. According to the invention, each one of said cross beams (3) is provided, at least at one end of the centering, with an extension arm (9) which can be moved lengthwise of the cross beam to adjust the total width of said steel construction so that it may be adapted to meet the requirements of supporting form boards with varying widths (FIG. 1).

4 Claims, 3 Drawing Figures

Fig. 1
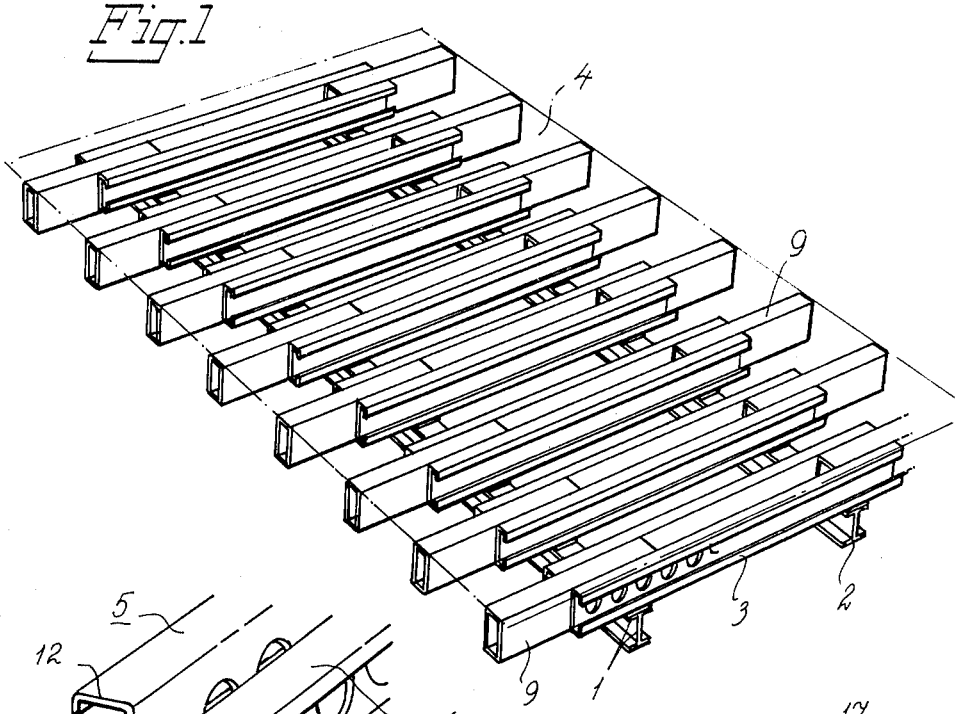
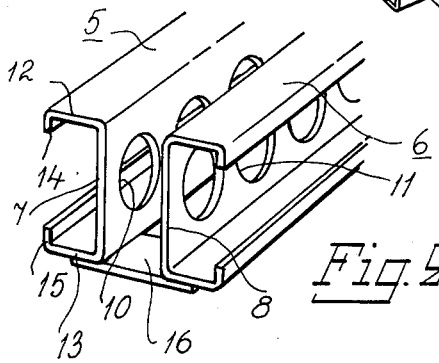
Fig. 2
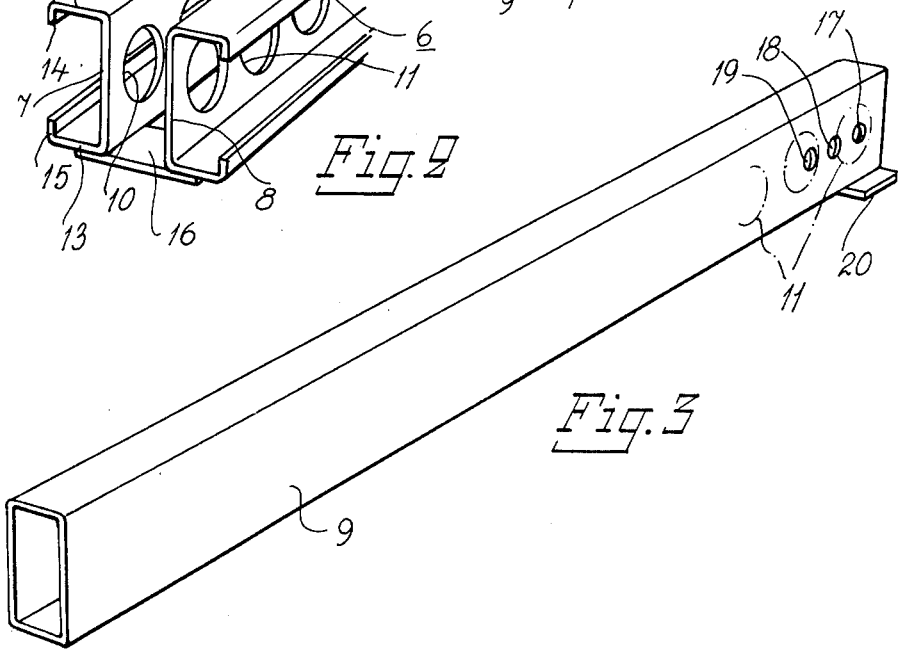
Fig. 3

CENTERING FOR CASTING CONCRETE ROOFS

BACKGROUND OF THE INVENTION

Large buildings such as office and industrial buildings and high apartment houses are nowadays constructed of reinforced concrete. Concrete roofs are cast together with the load-carrying walls into a continuous system of outwards open room-forming cells constituting a load-carrying building construction. Non-load-carrying partition walls of prefabricated elements or light bricks are built-in as planned between the load-carrying concrete walls. Finally, the building construction is terminated with a facade of prefabricated facade elements. The modern building technology has been aimed at a mechanized materials handling where the mast crane is of dominant importance. The concrete casting technique has been directed to the use of finished form elements which can be used several times for the casting of walls and roofs.

Cross-reinforced roofs or archs are cast one floor after the other according as the casting of the walls has been completed. For the casting use is made of a form table or centering consisting of a rectangular steel construction with two longitudinal beams having a pluarlity of cross beams welded thereto at equal spaces, for example 600 mm, to support a fiberboard or metal sheet onto which the roof will be cast. The centering is supported by a framework supported by a plurality of wheeled legs so that the framework may be moved in position. Furthermore, the legs are provided with screw spindles by means of which the framework may be lifted until the wheels get clear and the entire framework rests steady on the floor.

The width of the centering is governed by the space between the walls, and its length may be changed according to need. Generally, a length of, for example, 4–6 meters is chosen, and two or more centerings may be jointed with the short sides and the ends of the longitudinal beams abutting each other.

In the course of mounting for casting, the centering is hoisted by means of a fork-lift operated by the crane operator and lifted in place between the newly cast walls of the building, levelled into the desired ceiling height and sealed against the walls by means of suitable packing means. After armouring, casting the concrete mass and hardening thereof, the packing means are removed and the framework with the centering resting thereon is lowered on to its wheels and removed.

The concrete casting technique briefly described herein implies a substantial rationalization with resulting cost savings and has come into common practice. Nevertheless, it suffers from serious drawbacks. Frequently, the centerings consist of all-welded constructions which are sold or leased by the manufacturer to the building contractors. However, almost invariably there is a need of centerings with different widths for various building projects. By way of example, in one case the width may be 3.36 m, in another case 3.60 m. If only 3.60 m wide centerings are available at the site and there would be a need of 3.36 m wide centerings, it therefore often happens that all cross beams are cut down to 3.36 m by means of a cutting torch. Each time such a centering has been cut down, its cross beams must be lengthened with joint pieces or further cut down to meet the actual need. This work is very cumbrous and the costs involved have been estimated amounting approximately to half the costs of a new centering. Moreover, there will arise a large wastage of material resulting in further increased costs.

SUMMARY OF THE INVENTION

According to the present invention, there is now provided a centering with adjustable width rendering it possible, with one and the same centering, to cast roofs the widths of which may be varied within a relatively wide range.

The centering according to the invention comprises a rectangular steel construction including two longitudinal girders and a plurality of cross beams welded thereto in parallel spaced relationship to support a flat form board, wherein each one of said cross beams, at least at one end thereof, is provided with an extension arm displacable in the transverse direction of the centering, said arm slidably engaging the cross beam in a manner such that its upside lies flush with a geometrical plane touching the top surfaces of all cross beams, and wherein said arm is displacable with its end outside of the end of the cross beam to support a form board the width of which is larger than the nominal width of the centering.

In a preferred embodiment of the invention, each one of the cross beams of the centering comprises a pair of channel irons welded in spaced relationship to the longitudinal girders with their webs facing one another and with the flanges turned outwards, wherein an extension arm in the shape of a square tube is arranged at each end of each one of the cross beams within the space between the webs of the channel irons, said arms being displacable with slip fit in the longitudinal direction of the cross beams, the length of said square tube being maximum half of the length of said cross beam, its width corresponding substantially to the width between the channel irons, and its height being substantially equal to the height of said channel irons.

BRIEF DESCRIPTION OF THE DRAWINGS

The invention will be described hereinafter with reference to the accompanying figures:

FIG. 1 shows diagrammatically a centering according to the invention in perspective;

FIG. 2 shows the end of a cross beam; and

FIG. 3 shows an extension arm adapted to be inserted into a cross beam.

DESCRIPTION OF THE INVENTION

The centering shown in FIG. 1 comprises a rectangular steel construction of two longitudinal I-beams 1, 2 and a plurality of cross beams 3 welded thereto in parallel spaced relationship to support a flat form board indicated in FIG. 1 with a frame 4 drawn in dashed lines. As shown in FIG. 2, the cross beam consists of a pair of channel irons 5, 6 arranged in parallel and with the webs 7, 8 facing one another. Arranged at each end of each one of the cross beams 3 is an extension arm 9 in the shape of a square tube which is slidable with slip fit in the longitudinal direction of the cross beam. In order that the two extension arms 9 in a cross beam 3 may be maintained inserted completely, the length of each extension arm 9 should be at most half the length of the cross beam 3. The width of the extension arm corresponds substantially to the width between the channel webs, with due regard taken to the slidability. The height of the extension arm should be equal to the height of the cross beam in order to lie flush with the upper flanges thereof.

The cross beam 3 used in the preferred embodiment of the invention is shown in more detail in FIG. 2. A plurality of apertures 10, 11 are provided in spaced relationship in the web 7 and 8 of each channel iron 5 and 6, respectively, with the aim of saving of weight and, moreover, the flanges 14, 15 are bent towards one another to form narrow aligned flanges 14, 15 thereby increasing the bending resistance of the beam.

For guiding the extension arm 9, a flat bar steel 16 is welded across the ends of the bottom flanges of the channel irons 5, 6.

In FIG. 3 an extension arm 9 is shown in the shape of a square tube with rectangular cross-section. The tube is provided, at the end thereof facing the center of the centering, with three pairs of through holes 17, 18, 19 extending through the two vertical walls (only the foremost of which shown in the figure). Said holes are provided at such a distance from each other that one pair of holes will always be located within a pair of apertures 10, 11 in the cross beam, irrespectively of the telescoped position of the arm 9 within the cross beam 3. Accordingly, a bolt may be inserted through the tube to lock it in the desired telescoped position with the use of washers overlapping the actual apertures 10, 11 in the cross beam.

It is also advantageous at the bottom of the inner end of the square tube 9 to weld a flat bar steel 20 the width of which is greater than the space between the channel irons 5, 6 so that upon telescoping of the tube 9 to its full length, the flat bar steel 20 will be stopped by the flat bar steel 16 at the outer end of the cross beam 3 and prevented from getting loose.

FIG. 3 shows how the through holes may be arranged in relation to the apertures 11 in the cross beam. Thus, it is possible in the manner illustrated to adjust the telescoped length of the extension tube 9 within a millimeter.

Accordingly, with only two centerings of the type suggested according to the invention it is possible to supply all centering widths between, for example, 1.5 and 4.3 meter. The smaller centering type then would have a minimum width of 1.5 meter, with a widening capability of up to about 2.5 meter, and the larger centering would have a minimum width of about 2.5 meter with widening capability of up to about 4.3 meter. Widths outwards of this range very seldom are required.

Although the invention is described in detail in respect to the example and the individual drawings, it will be clear that modifications in materials and structure can be made by those skilled in the art within the scope of the invention as defined in the appended claims.

What I claim is:

1. In a centering for casting concrete roofs, comprising a rectangular steel construction including at least two longitudinal girders and a plurality of cross beams welded thereto in spaced relationship to support a flat form board, the improvement in which each one of said cross beams, at least at one end thereof, is provided with an extension arm displacable in the transverse direction of the centering, said arm slidably engaging the cross beam in a manner such that its upside lies flush with a geometrical plane toughing the top surfaces of all cross beams, and said arm being displacable with its end outside of the end of the cross beam to support a form board, the width of which is larger than the nominal width of the centering, each one of said cross beams consists of a pair of channel irons welded in spaced relationship to the longitudinal girders with their webs facing one another and with the flanges turned outwards, and the extension arm is in the shape of a square tube arranged at each end of each one of said cross beams within the space between the webs of the channel irons, said arms being displacable with slip fit in the longitudinal direction of said cross beams, the length of said square tube being maximum half the length of said cross beam, its width corresponding substantially to the width between said channel irons, and its height being substantially equal to the height of said channel irons, each square tube at the bottom side of the end thereof projecting into the space between the channel irons, is provded with a plate welded thereto, said plate having a greater width than the space between the channel irons, and a flat bar steel is welded over the extreme ends of the bottom flanges of said channel irons to form a stop member for engagement with the plate on said square tube.

2. A centering according to claim 1 wherein each tube has a plurality of holes extending through the two vertical walls starting near the end of the tube facing the center of the centering and extending away therefrom and wherein a plurality of apertures are provided in spaced relationship along the web of each channel arranged so that one pair of holes will always be located within a pair of apertures and where by insertion of a bolt through said holes to lock it in a displaced position with respect to the channel iron.

3. In a centering for casting concrete roofs, comprising a rectangular steel construcion including at least two longitudinal girders and a plurality of cross beams welded thereto in spaced relationship to support a flat form board, the improvement in which each one of said cross beams, at least at one end thereof, is provided with an extension arm displaceable in a transverse direction of the centering, said arm slidably engaging the cross beam in a manner such that its upside lies flush with a geometrical plane touching the top surfaces of all cross beams so to form a flat plane on which said flat form may be supported, and said arm being displacable with its end ouside of the end of the cross beam to support a form board, the width of which is larger than the nominal width of the centering, each one of said cross beams consists of a pair of channel irons welded in spaced relationship to the longitudinal girders with their webs facing one another and with the flanges turned outwards, and the extension arm is in the shape of a square tube arranged at each end of each one of said cross beams within the space between the webs of the channel irons, said arms being displacable with slip fit in the longitudinal direction of said cross beams, the length of said square tube being maximum half the length of said cross beam, its width corresponding substantially to the width between said channel irons, its height being substantially equal to the height of said channel irons and the sides of the tube aligned with and against the webs of the channel irons.

4. A centering according to claim 3 wherein each tube has a plurality of holes extending through the two vertical walls starting near the end of the tube facing the center of the centering and extending away therefrom and wherein a plurality of apertures are provided in spaced relationship along the web of each channel arranged so that one pair of holes will always be located within a pair of apertures and whereby by insertion of a bolt through said holes to lock it in a displaced position with respect to the channel iron.

* * * * *

UNITED STATES PATENT OFFICE

CERTIFICATE OF CORRECTION

Patent No. 4,248,024 Dated February 3, 1981

Inventor(s) Claes-Inge S. Dahlström

It is certified that error appears in the above-identified patent and that said Letters Patent are hereby corrected as shown below:

In column 3, line 63, delete "toughing" and insert ---touching--- .

In column 4, line 14, delete "provded" and insert ---provided--- .

Signed and Sealed this

*Twenty-first* Day of *April 1981*

[SEAL]

*Attest:*

RENE D. TEGTMEYER

*Attesting Officer* *Acting Commissioner of Patents and Trademarks*